United States Patent [19]

Hopkins et al.

[11] Patent Number: 4,756,533

[45] Date of Patent: Jul. 12, 1988

[54] MULTIPLE JIG-SAW PUZZLE PROMOTIONAL LOTTERY GAME AND METHOD OF PLAYING SAME

[76] Inventors: James E. Hopkins, The Meadows, 14F, Ambler, Pa. 19002; William H. Newbauer, 701 Grant Rd., Lansdale, Pa. 19446

[21] Appl. No.: 946,473

[22] Filed: Dec. 24, 1986

[51] Int. Cl.[4] ..... A63F 9/10
[52] U.S. Cl. ..... 273/157 R
[58] Field of Search ..... 273/157 R

[56] References Cited

U.S. PATENT DOCUMENTS

| | | | |
|---|---|---|---|
| 1,570,906 | 1/1926 | McCord | 273/157 R X |
| 3,512,780 | 5/1970 | Allison | 273/157 R X |
| 4,336,664 | 6/1982 | Penick et al. . | |

FOREIGN PATENT DOCUMENTS

| | | | |
|---|---|---|---|
| 1317164 | 12/1962 | France | 273/157 R |
| 342912 | 2/1931 | United Kingdom | 273/157 R |
| 553798 | 6/1943 | United Kingdom | 273/157 R |

*Primary Examiner*—Anton O. Oechsle
*Attorney, Agent, or Firm*—David J. Johns

[57] ABSTRACT

A unique promotional lottery game combining both skill and chance is provided. Multiple jig saw puzzles, with identical jig saw patterns, are played by contestants simultaneously, puzzle pieces for all the puzzles received from a common, unsegregated, pool. Each contestant is challenged to separate the puzzle pieces using only visual clues on their faces, to place the puzzle pieces in the correct places, and to collect all the pieces needed to solve one or more puzzles. The game readily is combined with other promotional games, such as instant win games and sweepstake games.

12 Claims, 1 Drawing Sheet

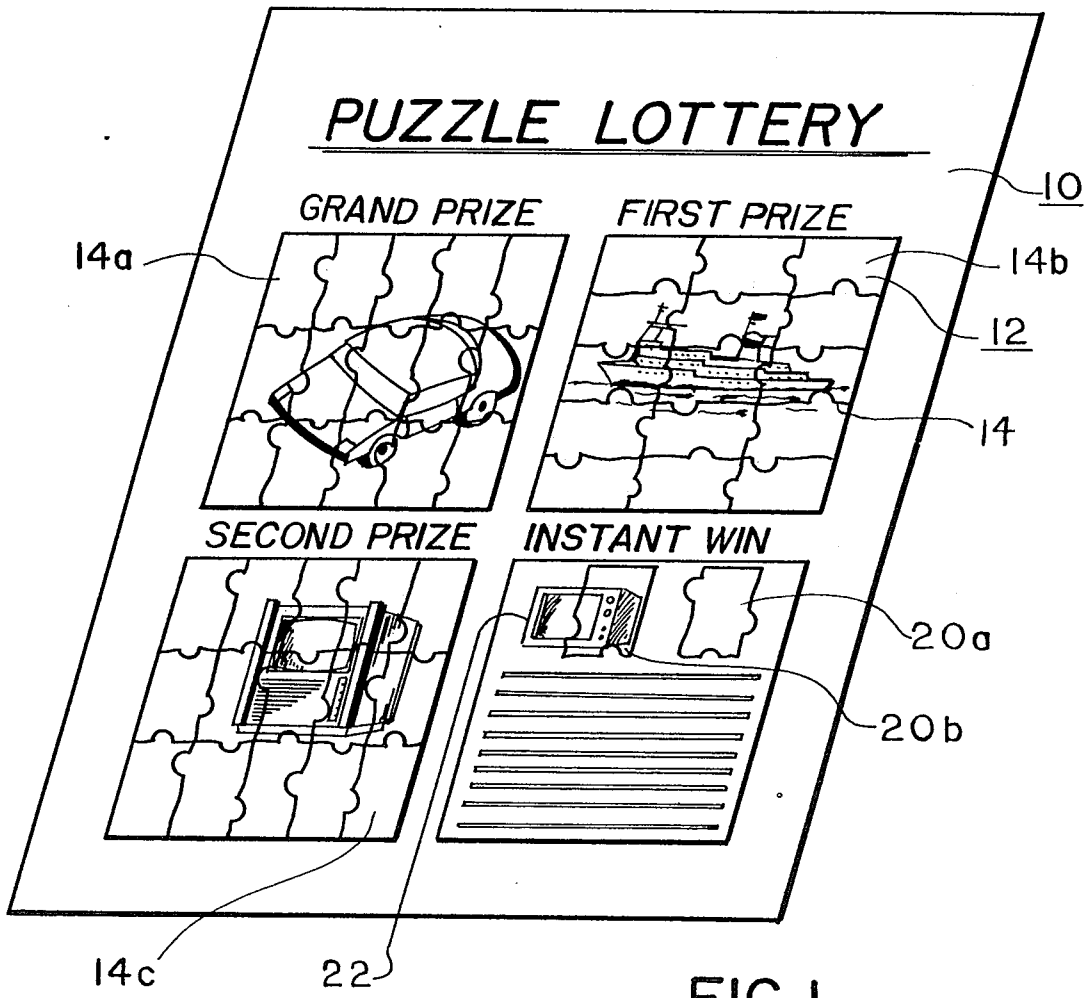
FIG. 1
FIG. 2
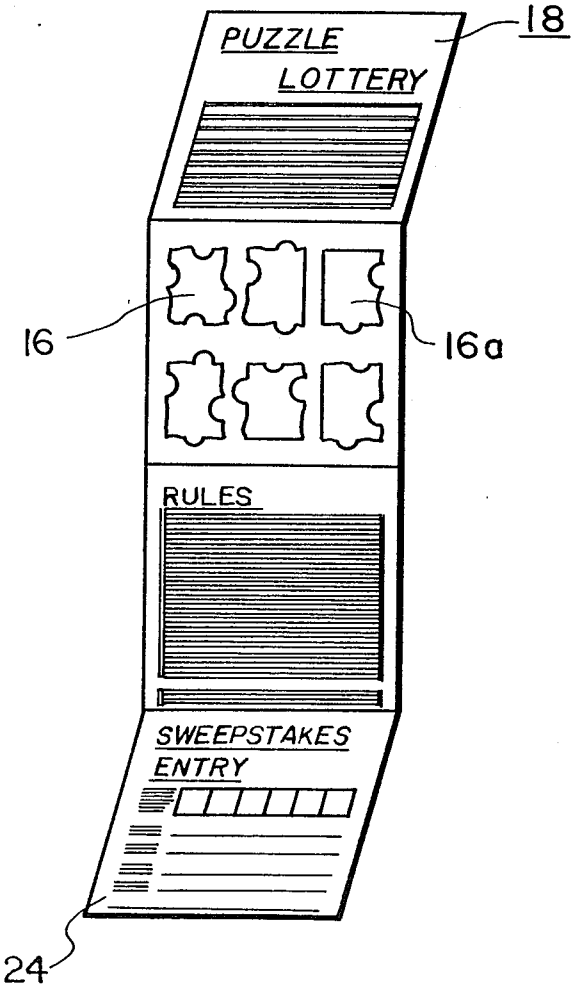

MULTIPLE JIG-SAW PUZZLE PROMOTIONAL LOTTERY GAME AND METHOD OF PLAYING SAME

BACKGROUND OF THE INVENTION

The present invention relates to the field of lottery or promotional games. More specifically, it involves lottery or promotional games using multiple jig saw puzzles which can be completed only upon repeated tries using a combination of both luck and skill.

Promotional games using jig saw puzzles which must be completed by or solved by the contestants are known. U.S. Pat. No. 3,512,780 issued to Allison on May 19, 1970, discloses a puzzle game which relies primarily on the luck of the contestants in collecting each of the pieces necessary to complete a rather simple puzzle. By contrast, U.S. Pat. No. 4,336,664 issued to Penick et al. on June 29, 1982, discloses a promotional game where the contestants are given all the necessary pieces and each contestant must exercise skill to complete the puzzle. U.S. Pat. No. 1,570,906 issued to McCord on Jan. 26, 1926 combines these elements by requiring each contestant to have both the luck to collect all the necessary pieces and the skill to complete a relatively complex puzzle.

Although such games as these may present an adequate level of challenge for many persons, these games do not compare favorably with other promotional games presently available. As consumers have had greater exposure to such games in recent years, demand has increased for games having multiple activities and on-going challenges. These criteria are particularly desired by merchants who wish to engage their customers and encourage an on-going game relationship which promotes repeated sales.

Merchants also desire promotional games which require skill. Such games tend to retain the customer's interest longer and they are subject to less stringent government regulations than games of mere chance.

In light of the foregoing, it is a primary object of the present invention to provide a promotional game using a jig saw puzzle format and relatively challenging puzzles which provide an additional level of challenge and activity by requiring contestants to complete multiple puzzle boards selecting from a single pool of puzzle pieces.

It is a further object of the present invention to provide a promotional game which can provide multiple levels of activities and multiple ways to win so to maintain and maximize customer interest.

SUMMARY OF THE INVENTION

The present invention provides a unique lottery game designed for promotional and advertising uses. The invention combines both luck and skill to present a particularly challenging lottery game.

The invention employs multiple jig saw puzzles which each contestant must play simultaneously. To increase the challenge of the game, all the jig saw puzzles use identical jig saw patterns, all the boards having identical shaped puzzle pieces in identical positions. The puzzle pieces are distributed from a common pool, without indication of which puzzle each piece may solve. Each contestant thus is challenged to collect all the required puzzle pieces and, using only the visual clues on the face of each piece, to separate the pieces and then solve the various jig saw puzzles.

The invention encourages on-going contestant participation, making it very useful for promotional activities. Additionally, the invention is readily combined with "instant win" games and sweepstake lotteries to maximize contestant participation.

DESCRIPTION OF THE DRAWING

FIG. 1 is a perspective view of one game board of the present invention.

FIG. 2 is a perspective view of one game card of the present invention.

DETAILED DESCRIPTION OF THE INVENTION

The present invention provides new apparatus and method for playing promotional or advertising lottery games which combine both chance and skill. Particularly, the invention is a lottery which employs multiple jig saw puzzles. Each contestant must play all the puzzles simultaneously, receiving puzzle pieces from a common, unsegregated, pool.

FIG. 1 shows the apparatus employed in the present invention. Each contestant receives a game board 10 which contains two or more puzzle boards 12. Each puzzle board 12 contains a picture of a prize to be won and an outline of positions 14 of puzzle pieces 16 which complete the puzzle.

Additionally, each contestant will receive from time to time game cards 18. Each of the game cards 18 contains one or more puzzle pieces 16 to be placed on one of the puzzle boards 12 to solve a portion of a puzzle by being placed within an outline of a corresponding position 14. The puzzle pieces 16 on the game cards 18 are not segregated in any manner which may clue the contestants as to which puzzle boards 12 the piece should be placed on. The contestants are thus challenged not only to complete correctly a jig saw puzzle, but also each contestant must first determine on which puzzle board 12 the piece 16 should be placed.

Adding to the challenge, the present invention contemplates having each of the puzzle boards 12 comprised of identically shaped jig saw patterns. Accordingly, each puzzle piece 16 is shaped to fit in an identical position 14 in the jig saw pattern of each puzzle board 12. A further level of complication may be added by shifting the orientation of the jig saw patterns on each of the puzzle boards so to make the identity of the patterns less noticeable. By way of illustration, in the drawing, puzzle piece **16*a* is shaped to fit in positions 14*a*, 14*b* and 14*c*. Each of the jig saw patterns is shifted 90° from the orientation in the previous puzzle. It is the contestant's task to use only the visual indications on the face of each puzzle piece 16** to determine its correct position.

To aid the contestants in the process of solving the multiple puzzles, each of the puzzle pieces 16 are backed with a self adhesive and the game cards 18 and the game boards 10 are provided with a release coating. The adhesive and coating may be of any of the forms known which permit repeated application and removal of an element to a surface. It has been found that standard glossy paper stock or other material providing a smooth, somewhat non-adhesive, surface provides a suitable release coating for use as puzzle boards 12. The puzzle pieces 16 thus are easily removed from the game cards 18 and placed on, and transfered between, positions 14 on the various puzzle boards 12.

For security reasons, each of the game cards 18 must be provided with means to conceal the puzzle pieces 16 it provides. Such security measures are commonly employed with lottery promotional games today. They make take the form of a separate covering which can be removed and discarded or, as is illustrated, the game card 18 itself may be folded and glued so to conceal the puzzle pieces until the contestant breaks the seal and unfolds the game card 18.

In order to maximize consumer participation and encourage repeat business, it is contemplated that the number of puzzle pieces 16 on each game card 18 will be less than the number required to solve any of the puzzle boards 12. FIG. 1 shows six puzzle pieces 16 on the game card 18 and each puzzle board 12 requiring twelve puzzle pieces 16 to be solved.

However, the inventors recognize that certain consumers may not wish to invest in a long term commitment with a promotional game. The present invention allows for these persons to participate without sacrificing the desired skill elements of the game. It is the inventors' intent to designate certain puzzle pieces 16 as "instant win" pieces 20*a* and 20*b*. These may be distinguished either by being a shape 20*a* which will not fit onto any of the puzzle boards 12, or by being the same shape as one of the standard puzzle pieces 16 but having different markings 20*b*. One possible embodiment of the latter form is shown in FIG. 1. There the instant win puzzle piece 20*b* completes a partially complete instant win picture 22 provided on each game board 10.

Additionally, the present invention is readily combined with other lottery games, such as mail-in sweepstake coupons 24, which may add a further dimension of interest for the contestants by providing another avenue by which to win.

The above described apparatus may be employed as either a pure lottery game or as a lottery game to be used for promotional or advertising purposes. In use, each of the puzzle boards 12 show an outlined picture of the prize or prizes which can be won upon completion of that particular puzzle. The puzzle pieces 16 have portions of the same picture in full color form. A completed (or solved) puzzle thus will provide a complete full color view of the prize which has been won.

Award of prizes is controlled by having limited production of one particular puzzle piece 16 corresponding to each puzzle board 12, and of all instant win puzzle pieces 20. That is, if only two first prizes are to be awarded, only two puzzle piece 16 will be distributed which will complete the first prize puzzle board 12; if only three instant win prizes are to be awarded, only three instant win puzzle pieces will be circulated. In this manner all other puzzle pieces 16 can be printed and distributed in large quantities, enticing all the consumers to continuing playing until their puzzle boards 12 are nearly completed.

While particular embodiments of the present invention are disclosed herein, it is not intended to limit the invention to such a disclosure and changes and modifications may be incorporated and embodied within the scope of the following claims.

What is claimed is:

1. A jig saw puzzle lottery game apparatus, suitable for advertising and promotion, combining both chance and contestant's skill, which comprises a game board containing multiple puzzle boards, each comprised of an identical jig saw pattern, to be played simultaneously; and a plurality of game cards, each containing puzzle pieces;

wherein each said puzzle piece is shaped to fit into a position on each said puzzle board, but said puzzle piece correctly solves a portion of only one said puzzle board;

each said game card is provided with means to conceal the puzzle pieces it contains; and each of the puzzle pieces to be contained on said game cards are randomly selected with respect to which puzzle board it may solve;

wherein selected game pieces are provided which do not solve any of the puzzle boards but fit in at least one space on said game board indicating immediate qualification for an instant prize.

2. Apparatus in accordance with claim 1 wherein each puzzle piece is provided with a self adhesion means and the game cards and the game board each are provided with a release coating means, whereby each puzzle piece may be removed from a game card, positioned on said game board, and later transfered to another position on said game board.

3. Apparatus in accordance with claim 1 wherein each game card is provided with a quantity of puzzle pieces less than the number of positions which must be filled on each puzzle board in order to solve said puzzle board, whereby each contestant is required to collect at least two game cards before solving any puzzle board.

4. Apparatus in accordance with claim 1 wherein each puzzle board corresponds with at least one particular prize to be won upon completion of said puzzle board.

5. Apparatus in accordance with claim 4 wherein an arbitrary puzzle piece for each puzzle board is chosen to be produced and distributed in a limited number of copies, and wherein the limited number corresponds to the quantity of that particular prize to be awarded in the course of said lottery game.

6. Apparatus in accordance with claim 5 wherein each prize to be awarded is depicted on the corresponding puzzle to be completed.

7. Apparatus in accordance with claim 1 wherein at least a portion of the instant prize to be won is depicted on each selected game piece.

8. Apparatus in accordance with claim 1 wherein said means to conceal the puzzle pieces comprises a portion of said game card folded over said puzzle pieces, and means to maintain said portion in a folded position until unfolded by a contestant.

9. A method of playing a lottery game combining both chance and a contestant's skill, which comprises providing a game board containing multiple puzzle boards having identical jig saw patterns, and a plurality of game cards, each said game card containing concealed puzzle pieces; wherein each of the puzzle pieces may be placed in the pattern of any one of the multiple puzzle boards, but each said piece correctly solves a portion of only one said puzzle board; and wherein selected puzzle pieces are provided which do not solve any of the puzzle boards but fit in at least one space on said game board indicating immediate qualification for an instant prize; and having each contestant expose the puzzle pieces contained on each said game card, determine the correct position on the game board for each said puzzle piece, and attempt to complete at least one of the puzzle boards or instant prize space to win a corresponding prize.

10. A method in accordance with claim 9 whereby each contestant is required to employ a plurality of said game cards before acquiring a sufficient number of puzzle pieces to solve any one of the puzzle boards.

11. A method in accordance with claim 9 wherein each prize corresponding to each puzzle board is depicted in whole on each said puzzle board and in part on corresponding puzzle pieces.

12. A method in accordance with claim 9 wherein at least a portion of the instant prize to be won is depicted on each selected puzzle piece.

* * * * *